US008371395B2

(12) United States Patent
Schoeps

(10) Patent No.: US 8,371,395 B2
(45) Date of Patent: Feb. 12, 2013

(54) HOUSING JOINT FOR A POWER TOOL

(75) Inventor: Knut Christian Schoeps, Tyresö (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 424 days.

(21) Appl. No.: 12/663,587

(22) PCT Filed: Jun. 5, 2008

(86) PCT No.: PCT/SE2008/000381

§ 371 (c)(1),
(2), (4) Date: Dec. 8, 2009

(87) PCT Pub. No.: WO2008/153466

PCT Pub. Date: Dec. 18, 2008

(65) Prior Publication Data

US 2010/0181087 A1 Jul. 22, 2010

(30) Foreign Application Priority Data

Jun. 11, 2007 (SE) ..... 0701394

(51) Int. Cl.
*B25D 17/24* (2006.01)

(52) U.S. Cl. ..... 173/162.2; 173/168; 173/200

(58) Field of Classification Search ..... 173/168, 173/200, 162.2, 162.1
See application file for complete search history.

(56) References Cited

U.S. PATENT DOCUMENTS

| | | | | |
|---|---|---|---|---|
| 3,972,491 | A * | 8/1976 | Ferris et al. | 244/17.27 |
| 4,450,921 | A | 5/1984 | Arvidsson et al. | |
| 4,635,732 | A * | 1/1987 | Gotsch et al. | 173/162.1 |
| 4,771,833 | A | 9/1988 | Honsa | |
| 5,251,367 | A * | 10/1993 | Ward et al. | 29/81.15 |
| 6,286,611 | B1 | 9/2001 | Bone | |
| 6,401,836 | B1 * | 6/2002 | Heinrichs et al. | 173/93 |
| 6,666,284 | B2 * | 12/2003 | Stirm | 173/97 |
| 6,827,157 | B2 * | 12/2004 | Fuchs | 173/217 |
| 7,140,451 | B2 * | 11/2006 | Yoshimizu et al. | 173/217 |
| 7,886,840 | B2 * | 2/2011 | Young et al. | 173/168 |
| 2003/0163924 | A1 * | 9/2003 | Hempe et al. | 30/388 |
| 2006/0144605 | A1 * | 7/2006 | Chen | 173/211 |
| 2006/0244223 | A1 * | 11/2006 | Zhou et al. | 279/62 |

OTHER PUBLICATIONS

English Language International Search Report dated Aug. 28, 2008 issued in parent Appln. No. PCT/SE2008/000381.

* cited by examiner

*Primary Examiner* — Brian D Nash

(74) *Attorney, Agent, or Firm* — Holtz, Holtz, Goodman & Chick, PC

(57) ABSTRACT

A power tool having a housing divided into two parts which are interconnected by a thread joint. Internal threads are provided on the housing parts. A tubular connection element has two external axially spaced thread sections which are provided for engagement with the internal threads on the housing parts. The tubular connection element has a thin walled waist section located between the external thread sections to provide a certain elastic deformation as a tightening torque is applied on the thread joint to thereby increase the clamping length of the thread joint. A resilient ring is carried on the waist section and is arranged to be elastically deformed by squeezing between the housing parts and the connection element at tightening of the thread joint, thereby providing a rotation locking friction force on the thread joint.

20 Claims, 2 Drawing Sheets

HOUSING JOINT FOR A POWER TOOL

This application is a U.S. National Phase Application under 35 USC 371 of International Application PCT/SE2008/000381 filed Jun. 5, 2008.

BACKGROUND OF THE INVENTION

1. Field of the Invention

The invention relates to a threaded joint for power tool housing parts. In particular the invention concerns a threaded joint for connecting two housing parts of a power tool.

2. Description of the Related Art

In power tools having housings comprising two or more parts kept together by threaded joints there is a problem to get a reliable connection between the parts which is able both to sustain vibrations and other forces caused by the internal rotating parts of the tool and to be easily broken to enable dismantling of the housing for service purposes. One common tool housing design comprises a tubular connection element having an external thread for engaging internal threads in both of the housing parts, thereby bridging the connection area and clamping the housing parts together. This type of threaded joint between the tool housing parts has a very short clamping length and is therefore very stiff, i.e. a full clamping load of the joint is obtained by a few degrees of rotation only. Accordingly, the joint may become completely loose if the clamping load is reduced by vibration forces and the tool housing parts are rotated just a few degrees. This will happen very easily if the joint has not been properly tightened to a required pretension level at, for instance, service operations.

The best way of ensure that the tool housing joint is not become loose is to tighten the screw joint or joints properly, i.e. to a correct pretension level. This is, however, not always done after dismantling of the tool housing at service operations. Another or complementary way of preventing loosening of the thread connection is to apply some locking agent on the thread at assembly of the housing parts, but that makes it difficult to loosen the joint and separate the housing parts at later service operations.

In another prior art tool design the tool housing joint has been formed with a left hand thread and locked with a chemical agent. The left hand thread is intended to withstand the rotational vibrations caused by the motor and transmission of the power tool. Still this type of housing joint is very stiff with a very short clamping length, which means that it is very much dependent on being correctly pretensioned when assembled and provided with a locking agent. Both measures may easily be overlooked and a poor connection between the housing parts would be the result.

BRIEF SUMMARY OF THE INVENTION

Another problem in prior art power tools of the above mentioned type is the difficulty to obtain a tight enough housing joint where no air leakage occurs.

One object of the invention as stated in the claims is to solve the above mentioned problems by obtaining a larger clamping length of the tool housing joint.

Further objectives and advantages of the invention will appear from the following specification and claims.

A preferred embodiment of the invention is described below in detail with reference to the accompanying drawing.

DETAILED DESCRIPTION OF THE INVENTION

Figure 1:
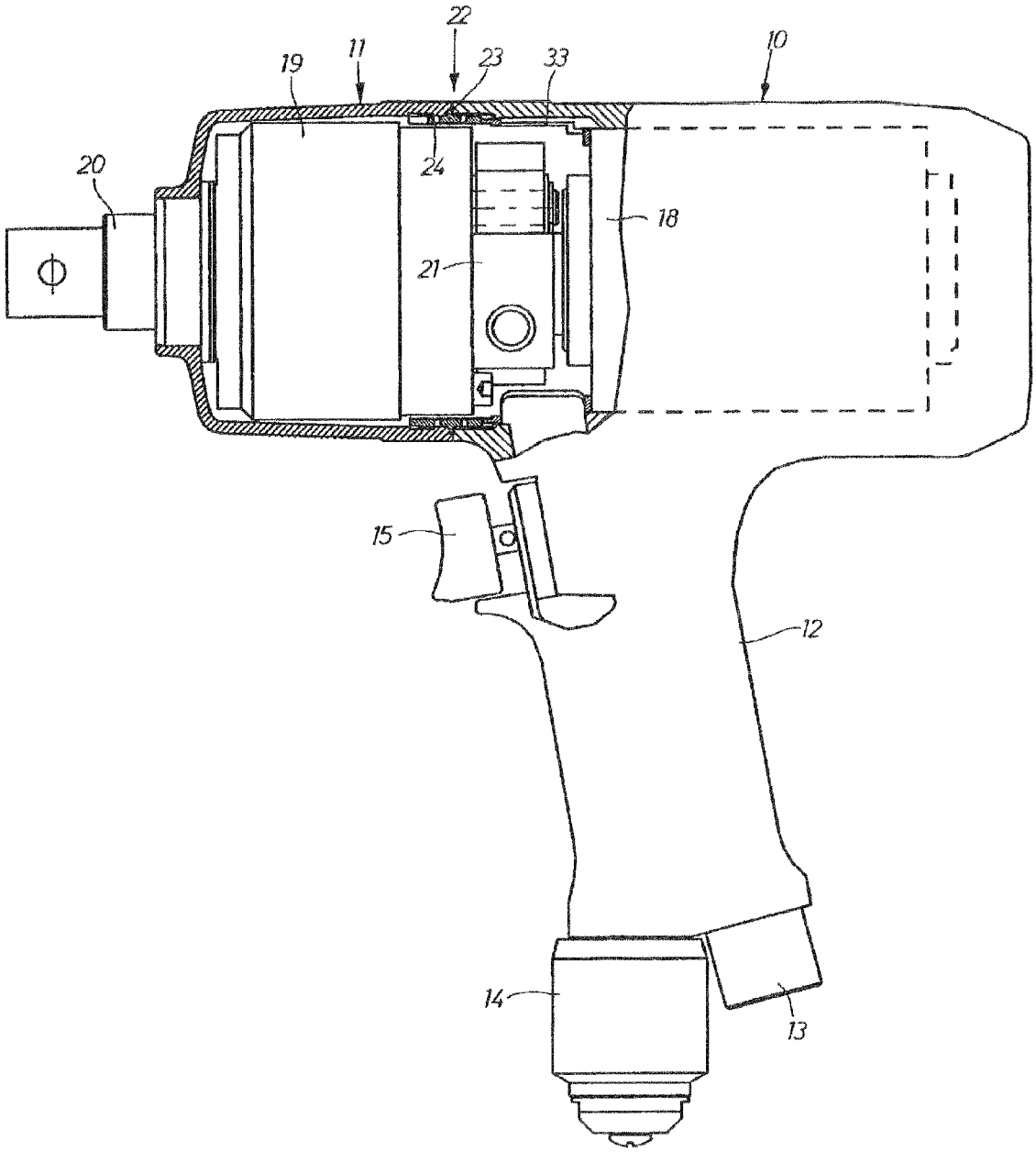
FIG. 1 shows a side view, partly in section, of a power tool according to the invention.

The power tool illustrated in the drawing figures is a pneumatic pistol type impulse nutrunner which comprises a tool housing divided into two parts 10 and 11, whereof a rear part 10 is formed with a handle 12 with a pressure air conduit connection 13, an exhaust silencer 14, and a throttle valve operated by a trigger 15. The rear part 10 of the housing includes a drive motor 18, whereas the front part 11 of the housing includes an impulse unit 19 with a square ended output shaft 20, and a shut off mechanism 21.

Figure 2:
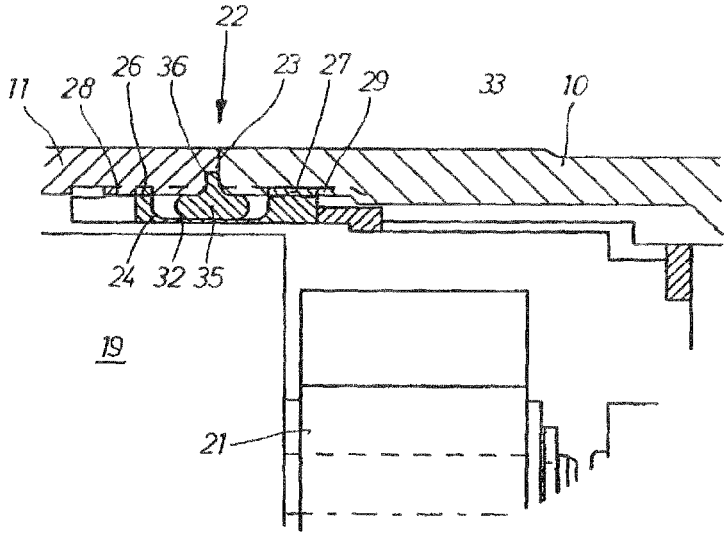
FIG. 2 shows on a larger scale a detail of the power tool in FIG. 1.

The two housing parts 10, 11 are rigidly interconnected in a connection area 22
by a thread joint 23. The latter comprises a tubular connection element 24 provided with two axially spaced thread sections 26,27 arranged to engage internal threads 28,29 on the housing parts 10,11. See FIG. 2. The connection element 24 also comprises a thin walled waist section 32 located between the thread sections 26,27. See FIGS. 3-5. The waist section 32 has a certain axial extent, and due to its thin wall thickness the waist section 32 will provide a certain elasticity when exposed to tensile forces as the thread joint 23 is tightened. The connection element 24 also acts as a clamping means for retaining the motor 18 in the rear housing part 10. This is obtained by having the connection element 24 threaded into the housing part 10 and exerting an axial clamping force to a distance sleeve 33.

The thin walled waist section 32 of the connection element 24 is arranged to carry an elastic O-ring 35 which is intended to be elastically deformed when squeezed between the connection element 24 and the housing parts 10,11 as the latter are clamped together by the thread joint 23. See FIG. 2. In order to axially locate the O-ring 35 the forward housing part 11 is formed with an annular bevelled surface or groove 36 into which the O-ring 35 is partly received as the parts 10,11 are assembled. Since the parts 10,11 have internal threads there are inevitably formed somewhat bevelled end surfaces on the parts 10,11 which together form an annular channel for receiving a part of the O-ring 35. The O-ring 35 has two important purposes, namely to form a friction lock between the housing parts 10,11 via the connection element 24, and to prevent air leakage between the parts 10,11. This friction lock is very important as a complementary means to prevent the housing parts 10,11 to become loose should the clamping force of the thread joint 23 be lost.

Figure 3:
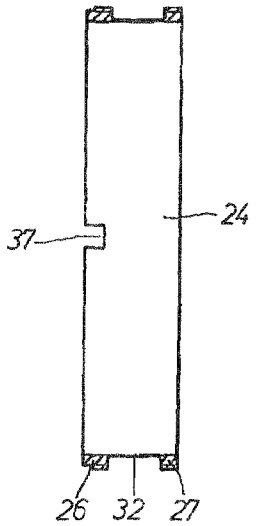
FIG. 3 shows a cross section of a connection element according to the invention.
Figure 5:
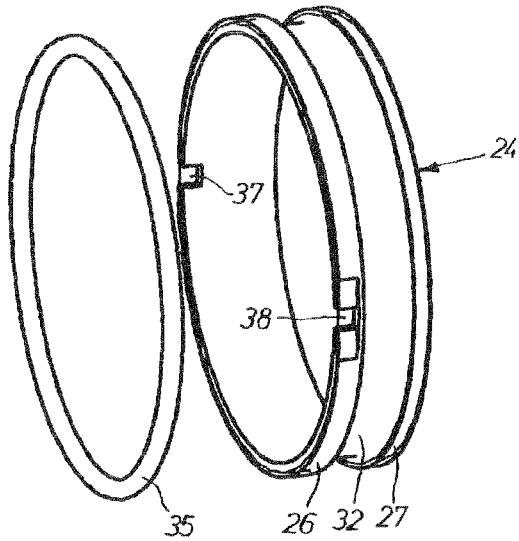
FIG. 5 shows a perspective view of the connection element and the elastic ring to be carried on the connection element.
Figure 4:
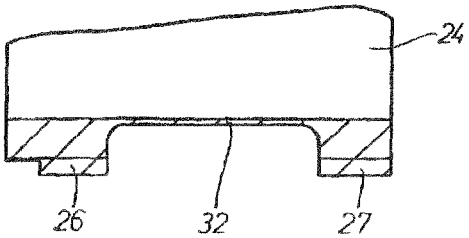
FIG. 4 shows on a larger scale a detail of the connection element in FIG. 3.

As illustrated in FIGS. 3 and 5 the connection element 24 is provided with a tool engaging means in the form of two diametrically opposite recesses 37,38. See FIG. 5. These are used at the assembly of the tool housing, because the assembly operation starts with mounting the connection element 24 in the rear housing part 10. The thread section 27 of the connection element 24 is threaded into the part 10 and tightened against the distance sleeve 33 to firmly retain the motor 18 in the housing. Then the O-ring 35 is entered onto the waist section 32 of the connection element 24, and the forward housing part 11 is threaded onto the thread section 26 of the connection element 24. A tool is applied on a non-illustrated tool grip on the forward housing part 11, and a tightening torque of a proper predetermined magnitude is applied on the part 11 so as to obtain a desired clamping force between the housing parts 10,11. Meanwhile, the O-ring 35 has been squeezed between the parts 10,11 and the connection element 24 such that a substantial friction engagement is obtained between the parts 10,11 and the connection element 24. A part of the O-ring 35 has entered the annular channel formed by the groove 36 to enhance air tightness between the housing parts 10,11.

When the tightening torque is applied on the forward housing part 11 there is exerted a tensile force on the connection element 24, and due to the rather weak thin walled waist section 32 there will be a certain elastic deformation of the connection element 24. This results in the fact that the thread joint 23 becomes less stiff. The axial extent of the waist section 32 makes the so called clamping length of the thread joint 23 larger. This means in practice that the joint 23 will need to be rotated over an extended angular interval before the clamping force between the parts 10,11 is lost. This means that the safety against self-loosening of the thread joint 23 is substantially improved. Moreover, by establishing a considerable friction engagement between the housing parts 10,11 via the O-ring 35 and the connection element 24 there is accomplished a further safety against rotation of the parts 10,11 in the loosening direction of the thread joint 23.

By using the thread joint arrangement according to the invention there is avoided the problems of loosening housing parts and the need for other measures to be taken like introducing left hand threads and chemical thread locking agents which result in undesirable dismantling problems at service operations.

The invention is above described in connection with an impulse nutrunner as an example but could be applied on other types of power tools. Accordingly, the invention is not limited to the described example but may be freely varied within the scope of the claims.

The invention claimed is:

1. A power tool including a housing, a drive motor, an output shaft, and a power transmission coupling the motor to the output shaft, wherein the housing comprises two separable parts joined together in a rigid connection in a connection area by a threaded joint, and wherein the threaded joint comprises:

a threaded tubular connection element arranged to co-operate with internal threads of the housing parts, said connection element having a certain axial extent and comprising:

a first thread section for engaging the internal thread of one of the hosing parts; and a second thread section for engaging the internal thread of the other one of the housing parts, the first thread section and the second thread section being axially spaced apart; and a thin walled waist section provided between said first thread section and said second thread section, said waist section serving to decrease the axial stiffness of the threaded joint by increasing the clamping length of the threaded joint.

2. The power tool according to claim 1, wherein said waist section is arranged to carry a resilient ring, wherein said ring is arranged to be clamped between the housing parts and the connection element when the housing parts are assembled, whereby said ring is elastically deformed to generate a friction force on the housing parts.

3. The power tool according to claim 2, wherein at least one of said housing parts is provided with an annular groove at the connection area, and wherein said groove is arranged to form an inwardly open annular channel for partly receiving said ring when the housing parts are clamped together by the threaded joint.

4. The power tool according to claim 3, wherein said resilient ring has the form of an O-ring.

5. The power tool according to claim 4, wherein said connection element includes a tool engaging means for threading the connection element into one of the housing parts before the other housing part is connected.

6. The power tool according to claim 5, wherein:

the power transmission comprises a hydraulic impulse generator;

one of the housing parts includes the drive motor; and the other housing part includes said impulse generator.

7. The power tool according to claim 4, wherein:

the power transmission comprises a hydraulic impulse generator;

one of the housing parts includes the drive motor; and the other housing part includes said impulse generator.

8. The power tool according to claim 3, wherein said connection element includes a tool engaging means for threading the connection element into one of the housing parts before the other housing part is connected.

9. The power tool according to claim 8, wherein:

the power transmission comprises a hydraulic impulse generator;

one of the housing parts includes the drive motor; and the other housing part includes said impulse generator.

10. The power tool according to claim 3, wherein:

the power transmission comprises a hydraulic impulse generator;

one of the housing parts includes the drive motor; and the other housing part includes said impulse generator.

11. The power tool according to claim 2, wherein said resilient ring has the form of an O-ring.

12. The power tool according to claim 11, wherein said connection element includes a tool engaging means for threading the connection element into one of the housing parts before the other housing part is connected.

13. The power tool according to claim 12, wherein:

the power transmission comprises a hydraulic impulse generator;

one of the housing parts includes the drive motor; and the other housing part includes said impulse generator.

14. The power tool according to claim 11, wherein:

the power transmission comprises a hydraulic impulse generator;

one of the housing parts includes the drive motor; and the other housing part includes said impulse generator

15. The power tool according to claim 2, wherein said connection element includes a tool engaging means for threading the connection element into one of the housing parts before the other housing part is connected.

16. The power tool according to claim 15, wherein:

the power transmission comprises a hydraulic impulse generator;

one of the housing parts includes the drive motor; and the other housing part includes said impulse generator.

17. The power tool according to claim 2, wherein:

the power transmission comprises a hydraulic impulse generator;

one of the housing parts includes the drive motor; and the other housing part includes said impulse generator.

18. The power tool according to claim 1, wherein said connection element includes a tool engaging means for threading the connection element into one of the housing parts before the other housing part is connected.

19. The power tool according to claim 18, wherein:

the power transmission comprises a hydraulic impulse generator;

one of the housing parts includes the drive motor; and the other housing part includes said impulse generator.

20. The power tool according to claim 1, wherein:

the power transmission comprises a hydraulic impulse generator;

one of the housing parts includes the drive motor; and the other housing part includes said impulse generator.

* * * * *